US012376692B2

(12) United States Patent
Mittal

(10) Patent No.: US 12,376,692 B2
(45) Date of Patent: Aug. 5, 2025

(54) MATTRESS COVERS AND METHODS OF MANUFACTURE

(71) Applicant: Sysco Guest Supply, LLC, Somerset, NJ (US)

(72) Inventor: Khushboo Mittal, Chatham, NJ (US)

(73) Assignee: Sysco Guest Supply, LLC, Somerset, NJ (US)

( * ) Notice: Subject to any disclaimer, the term of this patent is extended or adjusted under 35 U.S.C. 154(b) by 68 days.

(21) Appl. No.: 17/129,326

(22) Filed: Dec. 21, 2020

(65) Prior Publication Data

US 2022/0192401 A1 Jun. 23, 2022

(51) Int. Cl.

| | |
|---|---|
| ***A47G 9/02*** | (2006.01) |
| ***A47C 31/10*** | (2006.01) |
| ***D05B 11/00*** | (2006.01) |

(52) U.S. Cl.

CPC ..... *A47G 9/0246* (2013.01); *D05B 11/005* (2013.01); *A47C 31/10* (2013.01); *A47C 31/105* (2013.01); *A47G 9/0207* (2013.01); *A47G 9/0238* (2013.01)

(58) Field of Classification Search

CPC ..... A47G 9/02; A47G 9/0238; A47G 9/0246; A47G 9/0207; A47G 9/0223; A47G 2009/0269; A47C 27/002; A47C 31/10; A47C 31/105; A47C 27/127; A47C 27/122

See application file for complete search history.

(56) References Cited

U.S. PATENT DOCUMENTS

| | | | | |
|---|---|---|---|---|
| 4,461,048 | A * | 7/1984 | Allaire, Jr. | A47G 9/0246 5/493 |
| 5,465,440 | A * | 11/1995 | Heptner | A47G 9/0246 5/497 |
| 8,015,636 | B2 * | 9/2011 | Bolish | A47G 9/0238 5/497 |
| 9,907,419 | B1 * | 3/2018 | Mun | A47G 9/0246 |
| 2006/0168726 | A1 * | 8/2006 | Cushing | A47G 9/0246 5/497 |

(Continued)

FOREIGN PATENT DOCUMENTS

| | | | | |
|---|---|---|---|---|
| CA | 2649271 | A1 * | 8/2009 | A47G 9/0246 |
| FR | 2814655 | A1 * | 4/2002 | A47G 9/0261 |

(Continued)

OTHER PUBLICATIONS

"Warp." Merriam-Webster.com Dictionary, Merriam-Webster, https://www.merriam-webster.com/dictionary/warp. Accessed Aug. 18, 2022. (Year: 2022).*

(Continued)

*Primary Examiner* — David R Hare
*Assistant Examiner* — Deborah Talitha Gedeon
(74) *Attorney, Agent, or Firm* — Lowenstein Sandler LLP

(57) ABSTRACT

A mattress cover includes a fabric substrate having a top surface, a foot portion, a first side portion, and a second side portion, wherein the foot portion, the first side portion, and the second side portion each have two edges, wherein at least a portion of one edge of the foot portion is stitched or sewn together with one edge of the first side portion, and wherein at least a portion of a second edge of the foot portion is stitched or sewn together with one edge of the second side portion.

21 Claims, 5 Drawing Sheets

(56) References Cited

U.S. PATENT DOCUMENTS

| | | | | |
|---|---|---|---|---|
| 2007/0056100 | A1* | 3/2007 | Stewart | A47G 9/0246 5/497 |
| 2007/0266495 | A1* | 11/2007 | Stribling | A47G 9/0246 5/497 |
| 2018/0235375 | A1* | 8/2018 | Garcia | A47C 27/00 |
| 2018/0360227 | A1* | 12/2018 | Martin | D04H 3/011 |
| 2019/0284737 | A1 | 9/2019 | Martin et al. | |

FOREIGN PATENT DOCUMENTS

| | | | |
|---|---|---|---|
| GB | 2551341 | A | 12/2017 |
| WO | 2017117485 | A1 | 7/2017 |
| WO | WO-2022073076 | A1 * | 4/2022 |

OTHER PUBLICATIONS

PCT/US2021/064533 International Search Report and Written Opinion dated Apr. 28, 2022, 12 pgs.

* cited by examiner

MATTRESS COVERS AND METHODS OF MANUFACTURE

TECHNICAL FIELD

The present disclosure generally relates to mattress covers and their methods of manufacture. More specifically, embodiments relate to mattress covers that may be used in households, hotels, motels, and healthcare facilities, and their methods of manufacture.

BACKGROUND

A conventional bed includes a box spring or bottom mattress or platform and a top mattress. Top mattresses are relatively heavy items. The weight of a mattress varies as a function of the coil core, the gauge of the coil, and the type of material or foam material used. An average king size mattress weighs between 85 and 115 pounds. High end king size mattresses with latex or memory foam can weigh as much as 300 pounds.

Hotel and motel chains as well as healthcare facilities which include hospitals, nursing homes and extended care facilities (hereinafter "commercial facilities") are known to only use flat sheets in their facilities due to the lower cost of flat sheets relative to fitted sheets and the desire to maintain fewer items in their respective inventories. As such, in order to properly make the beds in such facilities with flat sheets, housekeeping personnel need to lift the top mattress, which can be quite heavy, as discussed above. More particularly, in such facilities beds are made with a top sheet and a bottom sheet and a blanket. Both the top sheet and the bottom sheets are flat sheets.

In order to properly make the bed, the top and bottom sheets are tucked in between the top mattress and the box spring. More specifically, the bottom sheet is placed on the bed so that an equal amount of the sheet hangs off each side of the bed and an equal amount of the sheet hangs off the head and foot regions of the bed. The excess is tucked in at the head and foot regions of the bed to form so called "hospital corners." Next, the excess portions of the bottom sheet are tucked in next between the mattress and the box spring. The top sheet is then placed on top of the bottom sheet and placed and tucked in the same manner as the bottom sheet with hospital style corners except the head region is left open. In other words, only the foot and side portions of the top sheet are tucked between the mattress and the box spring. Next, a blanket is placed on the bed and may be tucked in the same manner as the top sheet.

In order to tuck the top and bottom sheets between the mattress and the box spring, the top mattress must normally be lifted. As mentioned above, mattresses can weigh up to 300 pounds. In order to make a bed, a housekeeping employee may need to lift a mattress up to ten (10) times per bed-four (4) times for the bottom sheet and three (3) times for the top sheet and the blanket. Assuming that each housekeeping employee in a hotel, motel, or healthcare facility makes at least 20-30 beds in a single shift, each housekeeping employee would typically lift a mattress at least 150-200 times per shift. Since bed making is a daily chore, housekeeping employees probably lift mattresses 150-200 times per shift on a daily basis.

Such sustained and repetitive lifting leads to employees developing back problems, resulting in employees missing work or, in severe cases, being placed on disability. Measures have been taken to mitigate such health problems. For example, simply using fitted sheets for the lower sheet reduces the number of times the mattress is to be lifted by 40%. However, fitted sheets do not provide the "hospital corners" in the lower bed sheets that hospitals are known for. Moreover, even using fitted sheets for the bottom sheet still requires a housekeeping employee to lift mattresses at least 90-160 times per day using the example above.

The use of fitted sheets is not without its drawbacks. For example, fitted sheets cost more than flat sheets. Also, frequent washing of sheets in commercial facilities tends to wear out the elastic in fitted sheets. As such, fitted sheets used in such facilities need to be replaced in applications in commercial facilities more frequently than straight sheets.

Thus, there is a need for further minimizing the need for housekeeping employees to lift mattresses while still making the bed look aesthetically neat.

SUMMARY

Briefly, the present invention relates to a mattress cover that may advantageously provide the benefits of being modular in terms of size and shape, easily removable and replaceable, comfortable and secure, all while maintaining an aesthetically, orderly, or neat and trim look.

More specifically, the present invention relates to a system and method for facilitating making beds of all sizes with one or more mattress covers by minimizing lifting of the mattress so that mattress cover can be tucked between the upper mattress and the box spring or platform without lifting the top mattress as many times. As such, flat sheets and blankets made in accordance with the present invention can be tucked between a mattress and box spring or platform virtually effortlessly without the need to lift the top mattress as many times. The present invention thus increases the efficiency of the housekeeping staff leaving more time for the housekeeping staff to attend to the rest of the room.

Accordingly, one example embodiment is a mattress cover including a fabric substrate having a top surface, a foot portion, a first side portion, and a second side portion. The foot portion, the first side portion, and the second side portion each have two edges. At least a portion of one edge of the foot portion is stitched or sewn together with one edge of the first side portion, and at least a portion of a second edge of the foot portion is stitched or sewn together with one edge of the second side portion. The depth of the foot portion can be greater, equal to, or lesser than a depth of the first side portion and second side portion. According to one embodiment, one edge of the foot portion may be partially or completely stitched or sewn together with one edge of the first side portion, and wherein the second edge of the foot portion is completely stitched or sewn together with the one edge of the second side portion. A length of the seam or sewn portion or stitched portion can be greater than or equal to or smaller than the depth of the mattress. According to one embodiment, the seam can also be tapering such that the two portions are stitched together tightly in some portions and less tightly in other portions along the same seam. The seam formed by the stitching or sewing may be formed on a bottom surface or an inside of the mattress cover, such that the seam is virtually invisible on an outside of the mattress cover.

The mattress cover can also include a head portion, wherein at least a portion of one edge of the head portion is stitched or sewn together with a second edge of the first side portion, and at least a portion of a second edge of the head portion is stitched or sewn together with a second edge of the second side portion. The mattress cover can include one or more layers of a second fabric in addition to the fabric substrate. The fabric substrate and second fabric can be made of any material suitable for purpose, including but not limited to a woven structure, knitted structure, nonwoven, and extruded base. In one embodiment, the fabric substrate and/or the second fabric comprises a woven structure including at least one of cotton, polyester, nylon, and rayon yarns in either warp and/or weft direction. For example, the fabric substrate may include 100% polyester yarns. The yarn density can be in the range of about 25 to 500 denier. The fabric substrate and/or the second fabric may have a patterned or textured surface for an enhanced aesthetics. A fabric weight of the fabric substrate can be in the range of about 10 gsm to 1000 gsm.

According to one embodiment, the mattress cover may include a head portion, wherein a portion of the head portion is folded backwards towards a bottom surface of the mattress cover, and seams are provided along an outer edge of the first and second side portions to retain the head portion in a folded position. At least a portion of the side portions may be configured to be resilient and extendible along a depth of a mattress such that said mattress cover is releasably secured to the mattress. At least one resilient member is further configured to be sandwiched between two layers of a fabric. At least one resilient member is attached along corners that conform with corners of the mattress. At least one resilient member is attached in a vertical direction along the depth of the mattress or at an angle relative to the vertical direction.

Another example embodiment is a method of making a mattress cover. The method includes providing a fabric substrate, cutting at least two shaped cutout at two adjacent corners of the fabric substrate to form a fabric substrate having a top surface, a foot portion, a first side portion, and a second side portion, wherein the foot portion, the first side portion, and the second side portion each have two edges. The method also includes sewing or stitching at least a portion of one edge of the foot portion together with one edge of the first side portion, and sewing or stitching at least a portion of a second edge of the foot portion together with one edge of the second side portion. The depth of the foot portion can be greater, equal to, or lesser than a depth of the first side portion and second side portion. According to one embodiment, one edge of the foot portion may be partially or completely stitched or sewn together with one edge of the first side portion, and wherein the second edge of the foot portion is completely stitched or sewn together with the one edge of the second side portion. A length of the seam or sewn portion or stitched portion can be greater than or equal to or smaller than the depth of the mattress. According to one embodiment, the seam can also be tapering such that the two portions are stitched together tightly in some portions and less tightly in other portions along the same seam. The seam formed by the stitching or sewing may be formed on a bottom surface or an inside of the mattress cover, such that the seam is virtually invisible on an outside of the mattress cover.

The mattress cover can also include a head portion, wherein at least a portion of one edge of the head portion is stitched or sewn together with a second edge of the first side portion, and at least a portion of a second edge of the head portion is stitched or sewn together with a second edge of the second side portion. The mattress cover can include one or more layers of a second fabric in addition to the fabric substrate. The fabric substrate and second fabric can be made of any material suitable for purpose, including but not limited to a woven structure, knitted structure, nonwoven, and extruded base. In one embodiment, the fabric substrate and/or the second fabric comprises a woven structure including at least one of cotton, polyester, nylon, and rayon yarns in either warp and/or weft direction. For example, the fabric substrate may include 100% polyester yarns. The yarn density can be in the range of about 25 to 500 denier. The fabric substrate and/or the second fabric may have a patterned or textured surface for an enhanced aesthetics. A fabric weight of the fabric substrate can be in the range of about 10 gsm to 1000 gsm.

According to one embodiment, the mattress cover may be formed to include a head portion, wherein a portion of the head portion is folded backwards towards a bottom surface of the mattress cover, and seams are provided along an outer edge of the first and second side portions to retain the head portion in a folded position. At least a portion of the side portions may be configured to be resilient and extendible along a depth of a mattress such that said mattress cover is releasably secured to the mattress. At least one resilient member is further configured to be sandwiched between two layers of a fabric. At least one resilient member is attached along corners that conform with corners of the mattress. At least one resilient member is attached in a vertical direction along the depth of the mattress or at an angle relative to the vertical direction.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

So that the manner in which the features, advantages and objects of the invention, as well as others which may become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only example embodiments of the invention and is therefore not to be considered limiting of its scope as the invention may admit to other equally effective embodiments.

DETAILED DESCRIPTION

The methods and mattress covers of the present disclosure can now be described more fully hereinafter with reference to the accompanying drawings in which embodiments are shown. The methods and encasements of the present disclosure may be in many different forms and should not be construed as limited to the illustrated embodiments set forth herein; rather, these embodiments are provided so that this disclosure can be thorough and complete, and can fully convey its scope to those skilled in the art. Like numbers refer to like elements throughout.

The term "mattress cover" as used throughout this disclosure means a flat sheet, duvet, top sheet, mock duvet, duvet cover or any other means that may be used to cover a mattress. More specifically, embodiments disclosed relate to mattress covers that may be used in households, hotels, motels, and healthcare facilities, and their methods of manufacture.

Figure 1:
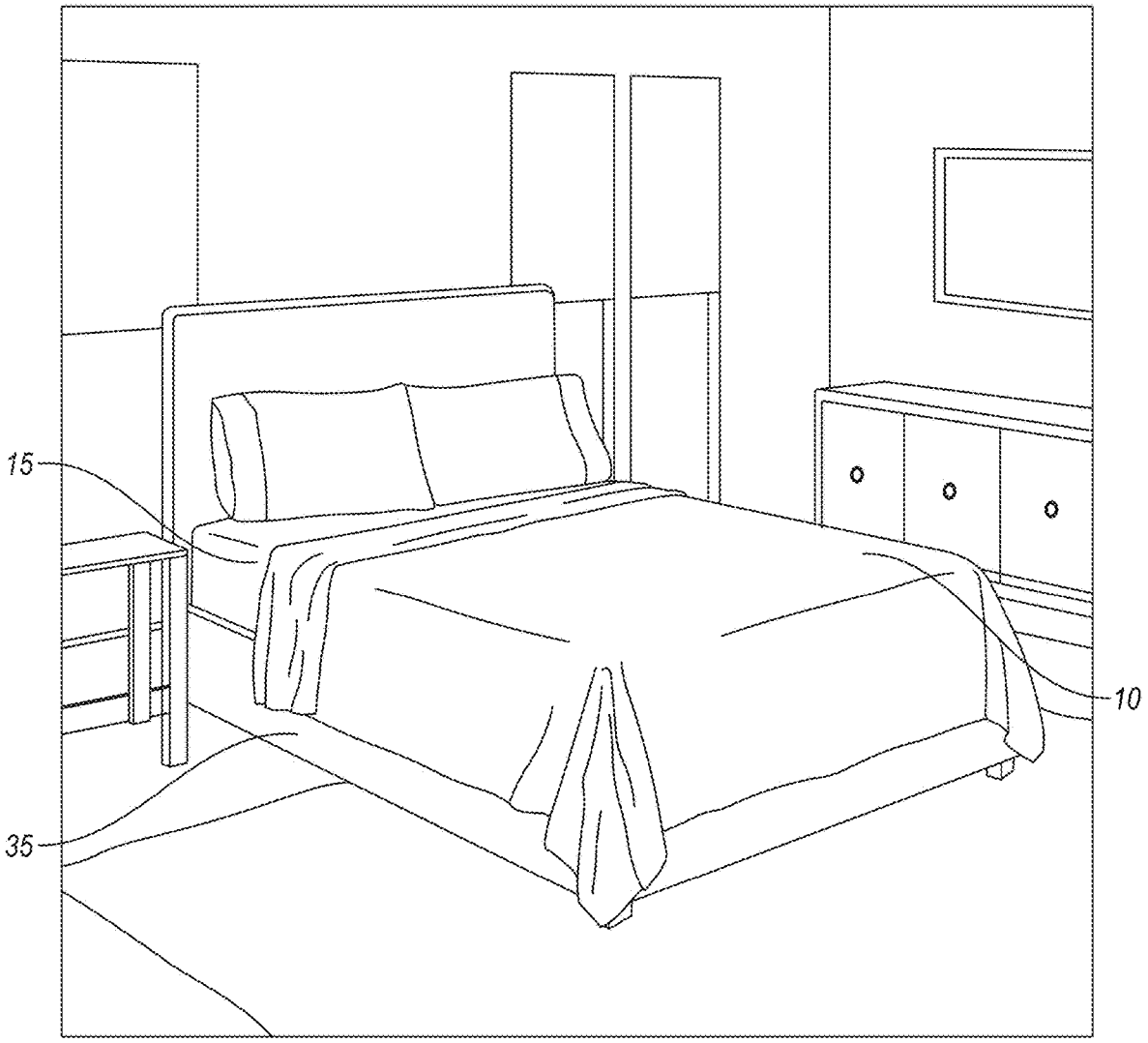
FIG. 1 (Prior Art)
FIG. 1 is a prior art set up including a conventional mattress carried by a platform bed, and a flat sheet spread on top of the mattress, according to the teachings of prior art.

Turning now to the figures, FIG. 1 is a prior art set up including a conventional mattress 15 carried by a platform bed 35, including a flat sheet 10 spread on top of the mattress, according to the teachings of prior art. The expression "mattress" referred to in the instant application refers to a fabric case filled with fillers including but not limited to one or more combinations of cotton, hair, feather, down, foam, rubber, springs, and the like. All embodiments claimed and described herein with regards to "mattress" are understood to include "mattress" used as a bed by itself, on a bedstead, water beds, air beds, "seat cushions" used on a sofa, couch, love seat, chair and the like, and tuffets.

Figure 2:
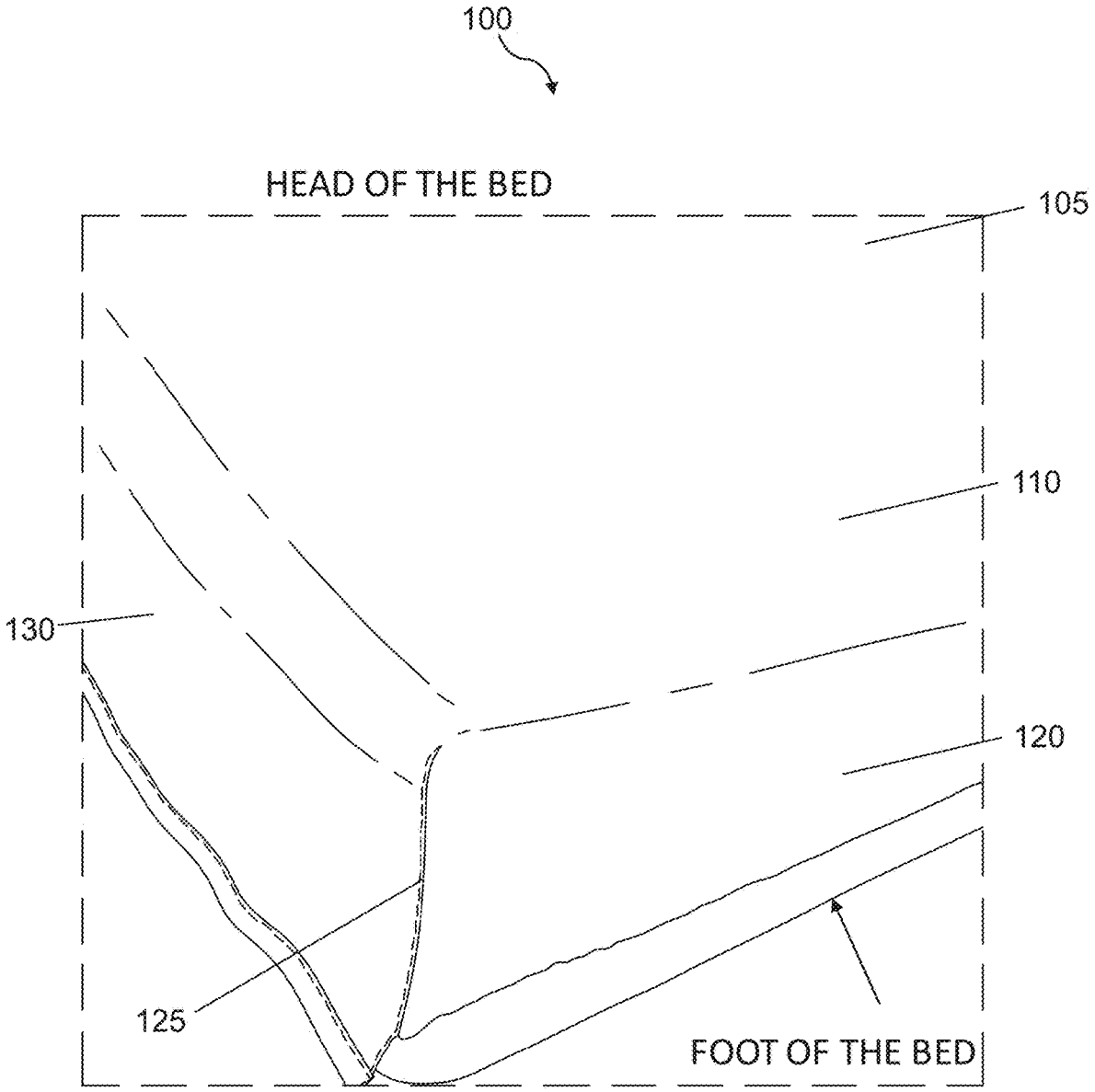
FIG. 2 illustrates a schematic representation of an exemplary mattress cover in accordance with an embodiment of the present disclosure.

FIG. 2 illustrates a schematic representation of an exemplary mattress cover 100 in accordance with an embodiment of the present disclosure. The mattress cover 100 includes a fabric substrate 105 having a top surface 110, a foot portion 120, a first side portion 130, and a second side portion (not shown here). The foot portion 120, the first side portion 130, and the second side portion each have two edges. At least a portion of one edge of the foot portion 120 is stitched or sewn together with one edge of the first side portion 130 at seam 125.

Similarly, at least a portion of a second edge of the foot portion is stitched or sewn together with one edge of the second side portion (not shown here). Here, the side portion 130 has a depth that is approximately equal to the depth of the mattress. However, the foot portion 120 is much longer than the depth of the mattress, and so a portion of the foot portion has been tucked under the mattress.

Figure 3:
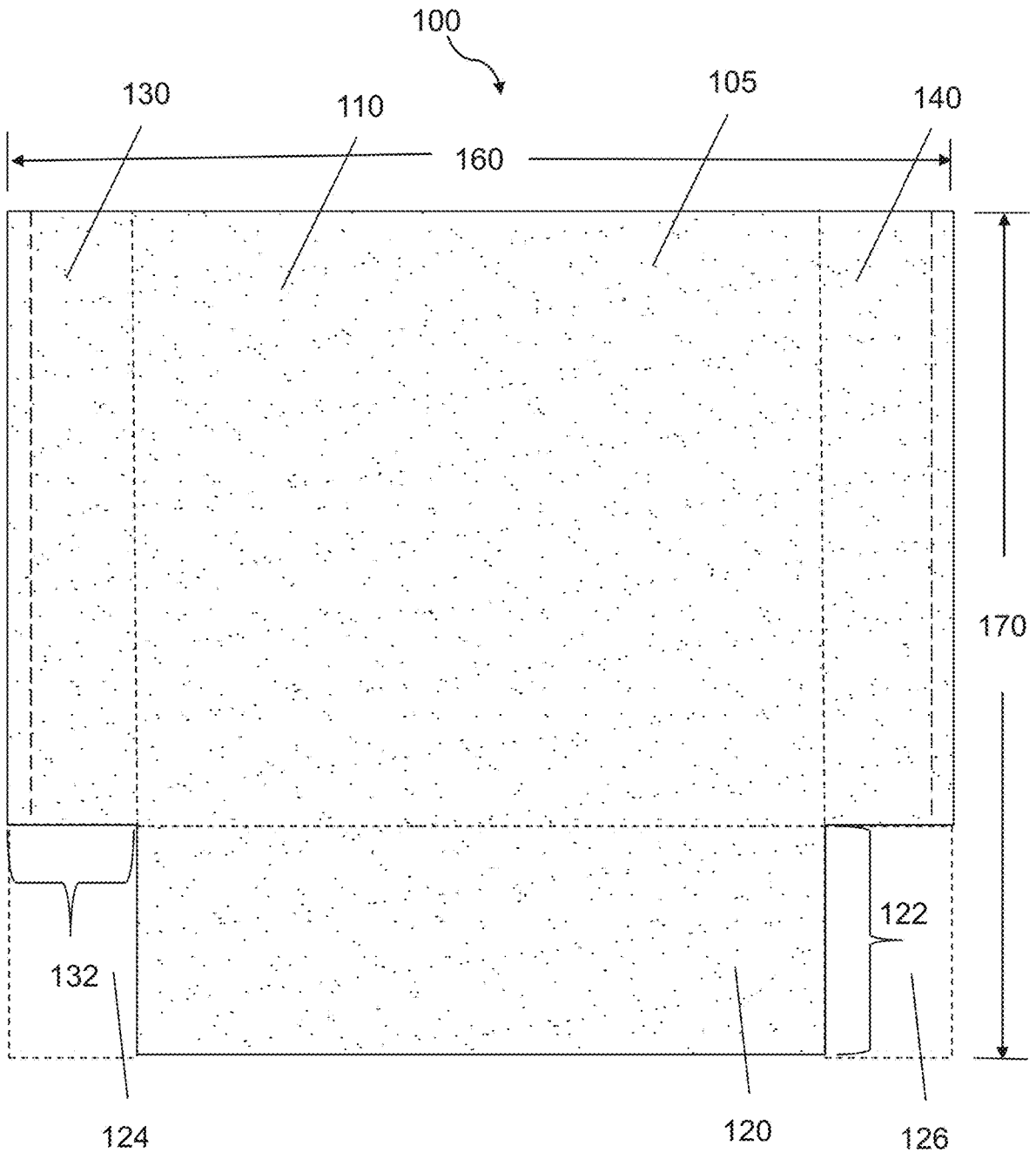
FIG. 3 illustrates example steps in a method for forming a mattress cover with polygonal shaped cutouts forming openings at two corners with at least two edges (before sewing) in accordance with an embodiment of the present disclosure.

FIG. 3 illustrates example steps in a method for forming a mattress cover 100 with polygonal shaped cutouts 124, 126 forming openings at two corners with at least two edges (before sewing) in accordance with an embodiment of the present disclosure. As illustrated in this two-dimensional depiction, the mattress cover 100 includes a fabric substrate 105 having a top surface 110, a foot portion 120, a first side portion 130, and a second side portion 140. Although the shaped cutout portions 124, 126 are illustrated to have a rectangular shape, the invention is not so limited. For example, the fabric substrate can be cut using straight lines, curves, or a combination of both. The foot portion 120, the first side portion 130, and the second side portion 140 each have two edge portions. At least a portion of one edge of the foot portion 120 is stitched or sewn together with one edge of the first side portion 130. Similarly, at least a portion of a second edge of the foot portion 120 is stitched or sewn together with one edge of the second side portion 140. The depth 122 of the foot portion 120 can be greater than a depth 132 of the first side portion 130 and second side portion 140, or it could be equal to, or lesser than a depth 132 of the first side portion 130 and second side portion 140.

According to one embodiment, one edge of the foot portion 120 may be partially or completely stitched or sewn together with one edge of the first side portion 130, or the second edge of the foot portion 120 may be completely stitched or sewn together with the one edge of the second side portion 140. A length of the seam or sewn portion or stitched portion can be greater than or equal or smaller than the depth of the mattress (132). According to one embodiment, the seam can also be tapering such that the two portions are stitched together tightly in some portions and less tightly in other portions along the same seam. In one embodiment, the seam formed by the stitching or sewing may be formed on a bottom surface or an inside of the mattress cover, such that the seam is virtually invisible on an outside of the mattress cover.

The mattress cover can also include a head portion (not shown) wherein at least a portion of one edge of the head portion is stitched or sewn together with a second edge of the first side portion 130, and at least a portion of a second edge of the head portion is stitched or sewn together with a second edge of the second side portion 140. The mattress cover 100 can include one or more layers of a second fabric in addition to the fabric substrate 105. The fabric substrate 105 and second fabric can be made of any material suitable for purpose, including but not limited to a woven structure, knitted structure, nonwoven, and extruded base. In one embodiment, the mattress cover may include fillers including but not limited to one or more combinations of cotton, hair, feather, down, foam, rubber, springs, and the like. In one embodiment, the fabric substrate and/or the second fabric comprises a woven structure including at least one of cotton, polyester, nylon, and rayon yarns in either warp and/or weft direction. For example, the fabric substrate may include 100% polyester yarns. The yarn density can be in the range of about 25 to 500 denier. The fabric substrate and/or the second fabric may have a patterned or textured surface for an enhanced aesthetics. A fabric weight of the fabric substrate can be in the range of about 10 gsm to 1000 gsm.

The method includes providing a fabric substrate, cutting at least two shaped cutout at two adjacent corners of the fabric substrate to form a fabric substrate having a top surface, a foot portion, a first side portion, and a second side portion, wherein the foot portion, the first side portion, and the second side portion each have two edges. The method also includes sewing or stitching at least a portion of one edge of the foot portion together with one edge of the first side portion, and sewing or stitching at least a portion of a second edge of the foot portion together with one edge of the second side portion. The depth of the foot portion can be greater, equal to, or lesser than a depth of the first side portion and second side portion. According to one embodiment, one edge of the foot portion may be partially or completely stitched or sewn together with one edge of the first side portion, and wherein the second edge of the foot portion is completely stitched or sewn together with the one edge of the second side portion. A length of the seam or sewn portion or stitched portion can be greater than or equal or smaller than the depth of the mattress. According to one embodiment, the seam can also be tapering such that the two portions are stitched together tightly in some portions and less tightly in other portions along the same seam. The seam formed by the stitching or sewing may be formed on a bottom surface or an inside of the mattress cover, such that the seam is virtually invisible on an outside of the mattress cover.

The mattress cover can also include a head portion, wherein at least a portion of one edge of the head portion is stitched or sewn together with a second edge of the first side portion, and at least a portion of a second edge of the head portion is stitched or sewn together with a second edge of the second side portion. The mattress cover can include one or more layers of a second fabric in addition to the fabric substrate. The fabric substrate and second fabric can be made of any material suitable for purpose, including but not limited to a woven structure, knitted structure, nonwoven, and extruded base. In one embodiment, the fabric substrate and/or the second fabric comprises a woven structure including at least one of cotton, polyester, nylon, and rayon yarns in either warp and/or weft direction. For example, the fabric substrate may include 100% polyester yarns. The yarn density can be in the range of about 25 to 500 denier. The fabric substrate and/or the second fabric may have a patterned or textured surface for an enhanced aesthetics. A fabric weight of the fabric substrate can be in the range of about 10 gsm to 1000 gsm.

According to one embodiment, the mattress cover may be formed to include a head portion, wherein a portion of the head portion is folded backwards towards a bottom surface of the mattress cover, and seams are provided along an outer edge of the first and second side portions to retain the head portion in a folded position. In one embodiment, at least a portion of the side portions may be configured to be resilient and extendible along a depth of a mattress such that said mattress cover is releasably secured to the mattress. For example, at least one resilient member is configured to be sandwiched between two layers of a fabric, or the seam portion may be made resilient. In another embodiment, at least one resilient member is attached along corners that conform with corners of the mattress. In one embodiment, at least one resilient member is attached in a vertical direction along the depth of the mattress or at an angle relative to the vertical direction.

Figure 4:
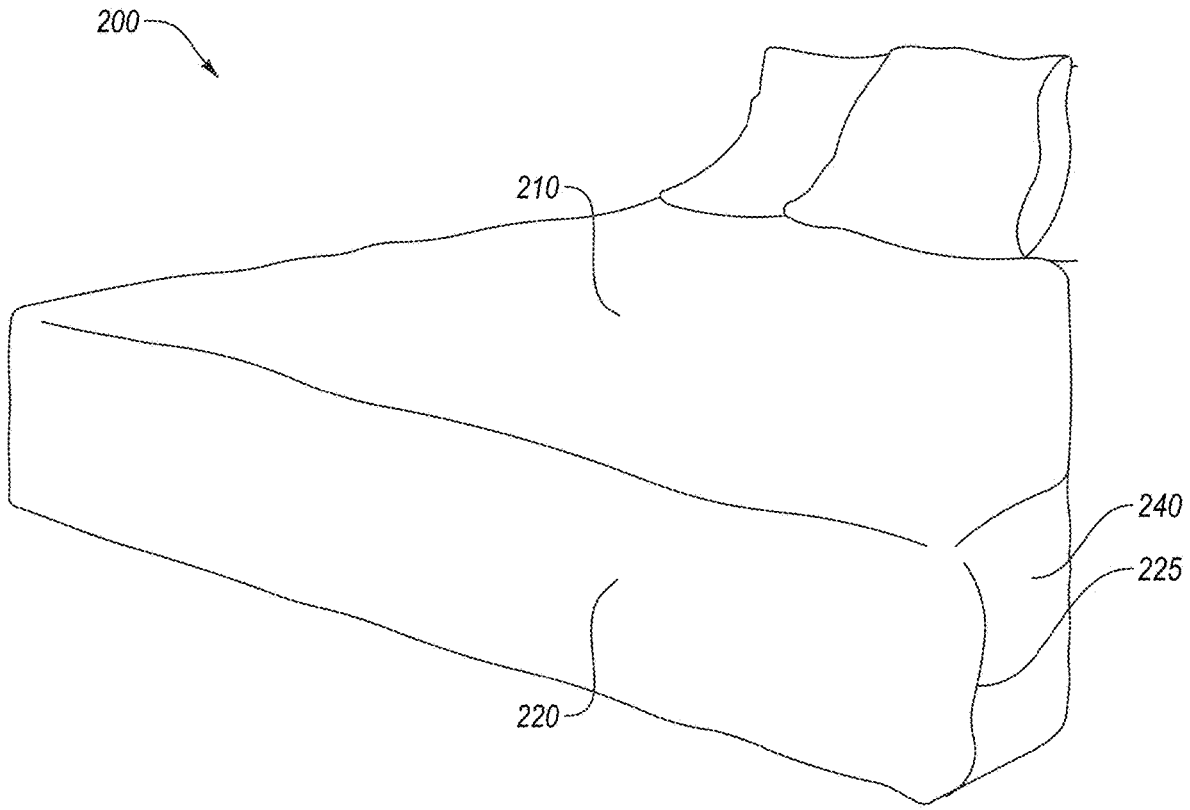
FIG. 4 is a photograph of a mattress cover showing a foot portion sewn together with the side portions in accordance with an embodiment of the present disclosure.

FIG. 4 is a photograph of a mattress cover 200 showing a foot portion 220 sewn together with the side portions 240 in accordance with an embodiment of the present disclosure. In this embodiment, the depth of the foot portion 220 is equal to the depth of the side portion 240, the edges of which are sewn or stitched together at seam 225. Here, the fabric substrate is cut using a combination of straight lines and curves, thereby forming a seam 225 that conforms to the shape of the mattress corner.

Figure 5:
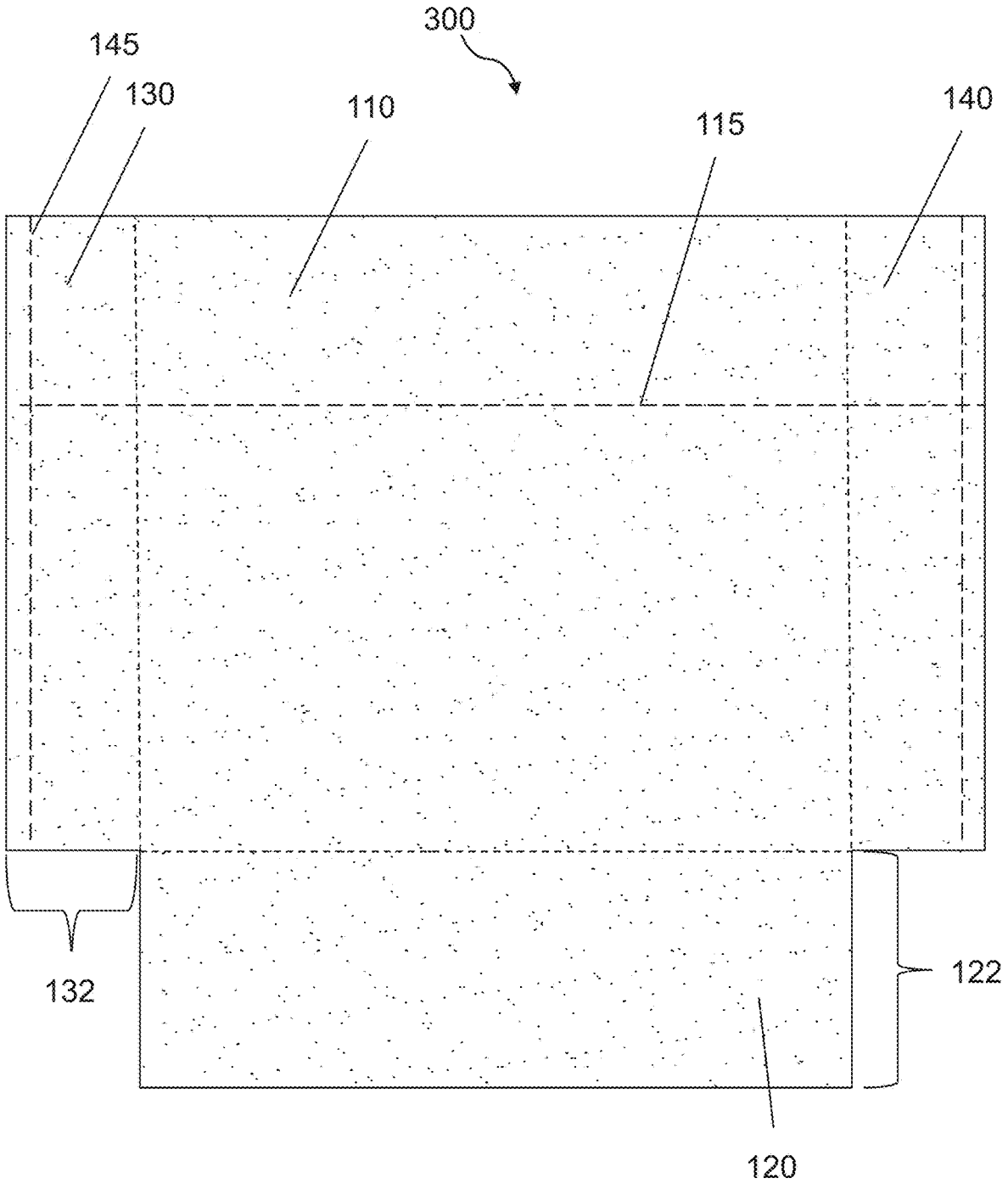
FIG. 5 illustrates a schematic representation of an exemplary mattress cover with a folded head portion in accordance with an embodiment of the present disclosure.

FIG. 5 illustrates a schematic representation of an exemplary mattress cover 300 with a folded head portion 115 in accordance with an embodiment of the present disclosure. According to this embodiment, the mattress cover 300 may include a head portion 115, wherein at least a portion of the head portion 115 is folded backwards towards a bottom surface of the mattress cover, and seams 145 are provided along an outer edge of the first and second side portions to retain the head portion in a folded position.

In one embodiment, at least a portion of the side portions may be configured to be resilient and extendible along a depth of a mattress such that said mattress cover is releasably secured to the mattress. For example, at least one resilient member may be configured to be sandwiched between two layers of a fabric, or the seam portion may be made resilient. In another embodiment, at least one resilient member is attached along corners that conform with corners of the mattress. In one embodiment, at least one resilient member is attached in a vertical direction along the depth of the mattress or at an angle relative to the vertical direction. In one embodiment, the mattress cover may also include one or more layers of fabric stiffeners, resilient material and the like in at least some portions of the sheets. The expression "resilient" referred to in the instant application refers to a property of a material that enables it to return to its original shape after being pulled or stretched. The expression "resilient member" referred to in the instant application may include elastomeric materials that are inherently resilient by nature, such as elastic and also materials that can be pulled or tugged and released by means of ropes, cords, drawstrings configured therein to achieve desired tensioning or release effect. The expression "resilient member" may also include fabric configured with resilience by techniques such as but not limited to smocking and shining. "Resilient member" in the instant application can take any form including but not limited to bands, tapes, strips, threads, and the like, which may be produced using Lycra® and the likes, an elastomer, polyurethane, or any other polymeric material. The expressions "sew" and "stitch" may be used interchangeably to imply fastening or joining by stitching or other forms of bonding, as known in the art and may be a manual process or may involve use of machines.

Now coming back to FIG. 3, it illustrates example steps in a method for forming a mattress cover 100 with polygonal shaped cutouts 124, 126 forming openings at the corners with at least two edges (before sewing) in accordance with an embodiment of the present disclosure. The method includes the step of providing a fabric substrate having a width 160 and a length 170. The next step involves cutting a rectangular shaped cutout 124, 126 at two adjacent corners of the fabric as to form two openings with at least two edges, thereby forming a mattress cover having a top surface 110 and a plurality of side surfaces 120, 130, 140.

The present disclosure provides various embodiments to achieve resilience and meet the intended objects of the disclosure. In an embodiment, at least a portion of the side surfaces 120, 130, 140 can be configured to be resilient. For instance, at least a portion of the side surfaces 120, 130, 140 can be made of stretchable material such as Lycra® or Spandex® and the like. In an embodiment, corners of the side surfaces that conform to the four corners of the mattress on which the contour sheet may be spread can be made of such resilient material. Alternatively, spaced apart portions of the side surfaces can be made of such resilient material. In another embodiment, the side surfaces can be monolithic and made entirely of such resilient material.

Furthermore, this invention is applicable not only to fluid-cell mattress but any type of mattress with a filler material. It is also possible to use a mattress main body using metal springs such as coil springs or spring steel linear materials instead of air spring of the cells, or a mattress main body whose entirety is formed of a polymeric elastomer like a polyurethane foam.

It will be appreciated by a person skilled in the art that although the mattress cover 100 has been described with respect to a mattress, the mattress cover 100 may alternatively be used on a box spring. Further, the mattress cover 100 may be provided in different sizes and shapes for use with mattresses, box springs, couch cushions, chair cushions, pillows and duvets, for example, or any stuffed or filled article (whether stuffed or filled by natural or man-made materials).

The mattress cover disclosed here can take the form of any of the following: bed skirts, contour sheets or fitted sheets that cover the mattress, top sheets or flat sheets, blankets or duvets and pillow shams among other items. The mattress cover not only provides comfort, but also provide the advantage of the washed regularly instead of frequently washing the mattresses, thereby providing equivalent effect of cleanliness and hygiene, which in turn increases user convenience and reduces associated costs and resources on a recurring basis. Additionally, these items also provide an appealing bed presentation especially with appropriate color combinations and designs. However, an important aspect from the point of view of aesthetic appeal, comfort and safety is how well the bedding items are laid and avert accidents due to overhanging portions that may cause tripping.

The mattresses covers in the present disclosure can be customized to fit any standard mattress size such as King, Queen, Twin, Full, and the like. The mattress cover disclosed in the above embodiments is a critical and basic item in bedding sets that is laid over the mattress and is intended to snugly fit the mattress. Such covers can also find application for seat cushions in sofas, couches, love seats, and tuffets. With varying depths of mattresses and seat cushions available in the market today, there is a need to ensure that mattress covers are standardized for a particular size and are yet able to cater to the varying depths of mattresses or cushions available for each size.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "operatively connecting" and its conjugated forms means to complete any type of required junction, including electrical, mechanical or fluid, to form a connection between two or more previously non-joined objects. If a first component is operatively connected to a second component, the connection can occur either directly or through a common connector. "Optionally" and its various forms means that the subsequently described event or circumstance may or may not occur. The description includes instances where the event or circumstance occurs and instances where it does not occur.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The encasements and methods described herein, therefore, are well adapted to carry out the objects and attain the ends and advantages mentioned, as well as others inherent therein. While example embodiments of the encasement and method have been given for purposes of disclosure, numerous changes exist in the details of procedures for accomplishing the desired results. These and other similar modifications may readily suggest themselves to those skilled in the art, and are intended to be encompassed within the spirit of the encasement and method disclosed herein and the scope of the appended claims.

What is claimed is:

1. A cover comprising:

a fabric substrate having a top surface, a foot portion, a head portion, and side portions comprising a first side portion, and a second side portion, wherein:

the foot portion, the head portion, the first side portion, and the second side portion each have two edges;

the foot portion comprises: a first rectangular shaped cutout on one end to form a first edge of the foot portion and a first edge of the first side portion, first edge of the foot portion being substantially perpendicular to the first edge of the first side portion; and a second rectangular shaped cutout on a second end to form a second edge of the foot portion and a first edge of the second side portion, the second edge of the foot portion being substantially perpendicular to the first edge of the second side portion;

at least a portion of the first edge of the foot portion is stitched or sewn together with at least a portion of the first edge of the first side portion;

at least a portion of the second edge of the foot portion is stitched or sewn together with at least a portion of the first edge of the second side portion;

the head portion has no cutouts;

a portion of the head portion is folded backwards towards a bottom surface of the fabric substrate;

at least a portion of a first edge of the head portion of the cover is stitched or sewn together with a first outer edge of the first side portion and at least a portion of a second edge of the head portion is stitched or sewn together with a second outer edge of the second side portion to retain the head portion in a folded position;

the first outer edge is substantially perpendicular to the first edge of the first side portion; and the second outer edge is substantially perpendicular to the first edge of the second side portion.

2. The cover according to claim 1, wherein a depth of the foot portion is greater than a length of the first side portion and the second side portion.

3. The cover according to claim 1, wherein the first edge of the foot portion is completely stitched or sewn together with the first edge of the first side portion, and wherein the second edge of the foot portion is completely stitched or sewn together with the first edge of the second side portion.

4. The cover according to claim 3, wherein a length of a sewn portion or stitched portion is greater than or equal or smaller than a depth of a mattress.

5. The cover according to claim 1, wherein a seam formed by stitching or sewing is formed on the bottom surface or an inside of the fabric substrate.

6. The cover according to claim 5, wherein the seam is substantially invisible on an outside of the fabric substrate.

7. The cover according to claim 1, further comprising one or more layers of a second fabric.

8. The cover according to claim 7, wherein the fabric substrate or the second fabric comprise at least one of a woven, knitted, nonwoven, or extruded base.

9. The cover according to claim 7, wherein the fabric substrate or the second fabric has a patterned or textured surface.

10. The cover according to claim 1, wherein at least a portion of the side portions comprise at least one resilient member that is resilient and extendible along a depth of a mattress such that the fabric substrate is releasably secured to the mattress.

11. The cover according to claim 10, wherein the at least one resilient member is sandwiched between two layers of a fabric.

12. The cover according to claim 10, wherein the at least one resilient member is attached along corners that conform with corners of the mattress.

13. The cover according to claim 10, wherein the at least one resilient member is attached in a vertical direction along the depth of the mattress or at an angle relative to the vertical direction.

14. The cover according to claim 1, wherein a fabric weight of the fabric substrate is in a range of about 10 gsm to 1000 gsm.

15. The cover according to claim 1, wherein the fabric substrate comprises at least one of cotton, polyester, nylon, or rayon yarns in either warp or weft direction.

16. The cover according to claim 15, wherein a yarn density of the fabric substrate is in a range of about 25 to 500 denier.

17. The cover according to claim 1, wherein the fabric substrate comprises 100% polyester yarns.

18. The cover according to claim 1, wherein a depth of the foot portion is lesser than a length of the first side portion and the second side portion.

19. The cover according to claim 1, wherein a depth of the foot portion is equal to a length of the first side portion and the second side portion.

20. A method comprising:

cutting two shaped cutouts at two adjacent comers of a fabric substrate to form the fabric substrate having a top surface, a foot portion, a first side portion, and a second side portion, wherein the foot portion, the first side portion, and the second side portion each have two edges, wherein the foot portion comprises: a first rectangular shaped cutout on one end to form a first edge of the foot portion and a first edge of the first side portion, first edge of the foot portion being substantially perpendicular to the first edge of the first side portion; and a second rectangular shaped cutout on a second end to form a second edge of the foot portion and a first edge of the second side portion, the second edge of the foot portion being substantially perpendicular to the first edge of the second side portion;

sewing or stitching at least a portion of the first edge of the foot portion together with at least a portion of the first edge of the first side portion;

sewing or stitching at least a portion of a second edge of the foot portion together with at least a portion of a first edge of the second side portion;

forming a head portion without cutouts in the fabric substrate by folding a portion of the head portion of the fabric substrate backwards towards a bottom surface of the fabric substrate; and sewing or stitching at least a portion of a first edge of the head portion together with a first outer edge of the first side portion and sewing or stitching a portion of a second edge of the head portion together with a second outer edge of the second side portion to retain the head portion in a folded position, wherein the first outer edge is substantially perpendicular to the first edge of the first side portion, and wherein the second outer edge is substantially perpendicular to the first edge of the second side portion.

21. The method according to claim 20, wherein a fabric weight of the fabric substrate is in a range of about 10 gsm to 1000 gsm.

* * * * *